US009492933B2

(12) United States Patent
Wain et al.

(10) Patent No.: US 9,492,933 B2
(45) Date of Patent: Nov. 15, 2016

(54) GUARD FOR A SHAVING RAZOR

(75) Inventors: Kevin James Wain, Reading (GB); Christian Reber Wester, San Diego, CA (US); Matthew Corey Cataudella, Boston, MA (US)

(73) Assignee: The Gillette Company, Boston, MA (US)

( * ) Notice: Subject to any disclaimer, the term of this patent is extended or adjusted under 35 U.S.C. 154(b) by 696 days.

(21) Appl. No.: 13/467,157

(22) Filed: May 9, 2012

(65) Prior Publication Data

US 2013/0081274 A1 Apr. 4, 2013

Related U.S. Application Data

(60) Provisional application No. 61/541,692, filed on Sep. 30, 2011.

(51) Int. Cl.
*B26B 21/40* (2006.01)

(52) U.S. Cl.
CPC ..... *B26B 21/4018* (2013.01)

(58) Field of Classification Search
CPC ..... B26B 21/4018; B26B 21/4025; B26B 19/40
USPC ..... 30/34.2, 34.05, 50
See application file for complete search history.

(56) References Cited

U.S. PATENT DOCUMENTS 2,064,878 A 12/1936 Birrell
2,183,554 A * 12/1939 Evans ..... B26B 21/18 30/41
2,600,880 A 6/1952 Karle
3,004,337 A 10/1961 Schweizer
3,724,070 A * 4/1973 Dorion, Jr. ..... 30/47
4,044,463 A 8/1977 Tietjens
4,310,968 A 1/1982 Buik et al.
4,535,537 A 8/1985 Ferraro et al.
4,562,645 A 1/1986 Dato et al.
4,683,096 A * 7/1987 Ferraro ..... 264/249
4,741,103 A 5/1988 Hultman
4,845,846 A 7/1989 Sinka
4,998,347 A 3/1991 Schachter
5,031,316 A 7/1991 Oldroyd
5,063,667 A 11/1991 Jacobson (Continued)

FOREIGN PATENT DOCUMENTS

CA 2334710 A1 * 12/1999 ..... B26B 21/4018
EP 0 314 266 A1 5/1989

(Continued)

OTHER PUBLICATIONS

PCT International Search Report with Written Opinion in corresponding Int'l appln. PCT/US2012/057833 dated Dec. 13, 2012.

*Primary Examiner* — Jennifer Swinney
(74) *Attorney, Agent, or Firm* — John M. Lipchitz; Kevin C. Johnson; Steven W. Miller

(57) ABSTRACT

A shaving cartridge with a housing, cap at a rear of the housing, one or more blades mounted to the housing in front of the cap, and a guard at a front of the housing. The guard has a top surface with a plurality of undulating rows extending parallel to the blade. The undulating rows have crests and valleys. The valleys comprise an elastomeric material and are stepped from a front of the guard to a rear of the guard.

7 Claims, 10 Drawing Sheets

(56) References Cited

U.S. PATENT DOCUMENTS

| | | | | |
|---|---|---|---|---|
| 5,092,042 | A * | 3/1992 | Miller et al. | 30/77 |
| 5,191,712 | A * | 3/1993 | Crook et al. | 30/34.2 |
| 5,313,705 | A | 5/1994 | Rivers et al. | |
| 5,313,706 | A * | 5/1994 | Motta et al. | 30/57 |
| 5,365,665 | A | 11/1994 | Coffin | |
| 5,388,332 | A | 2/1995 | Oldroyd | |
| 5,410,810 | A | 5/1995 | Gillibrand | |
| 5,416,973 | A * | 5/1995 | Brown et al. | 30/34.2 |
| 5,475,923 | A | 12/1995 | Ferraro | |
| 5,526,567 | A | 6/1996 | Carson, III et al. | |
| 5,590,468 | A | 1/1997 | Prochaska | |
| 5,802,721 | A | 9/1998 | Wain et al. | |
| 5,953,819 | A | 9/1999 | Simms et al. | |
| 6,085,421 | A | 7/2000 | Jorna et al. | |
| 6,131,287 | A * | 10/2000 | Prochaska | B26B 21/4018 30/34.2 |
| 6,233,829 | B1 * | 5/2001 | Oglesby et al. | 30/34.2 |
| 6,243,951 | B1 | 6/2001 | Oldroyd | |
| 6,276,062 | B1 * | 8/2001 | Prochaska | 30/50 |
| 6,298,557 | B1 | 10/2001 | Gilder | |
| 6,516,518 | B1 | 2/2003 | Garraway et al. | |
| 6,550,141 | B1 | 4/2003 | Rivers et al. | |
| 6,651,342 | B1 * | 11/2003 | Walker, Jr. | 30/34.2 |
| 6,675,479 | B1 * | 1/2004 | Walker et al. | 30/34.2 |
| 6,941,659 | B2 | 9/2005 | Gilder | |
| 7,111,401 | B2 | 9/2006 | Richard | |
| 7,540,088 | B2 | 6/2009 | Takeshita | |
| 7,703,361 | B2 * | 4/2010 | Johnson et al. | 83/13 |
| 8,590,162 | B2 * | 11/2013 | Park et al. | 30/50 |
| 8,726,518 | B2 * | 5/2014 | Bruno | 30/34.2 |
| 2002/0046465 | A1 * | 4/2002 | McCool et al. | 30/50 |
| 2003/0159291 | A1 | 8/2003 | Clark | |
| 2005/0126007 | A1 | 6/2005 | Aviza | |
| 2005/0246898 | A1 | 11/2005 | Gilder | |
| 2006/0277759 | A1 | 12/2006 | Follo | |
| 2007/0137045 | A1 * | 6/2007 | Follo et al. | 30/50 |
| 2008/0229583 | A1 * | 9/2008 | Fischer et al. | 30/34.2 |
| 2010/0175265 | A1 | 7/2010 | Bozikis et al. | |
| 2010/0313424 | A1 * | 12/2010 | Johnson et al. | 30/34.2 |
| 2010/0319198 | A1 * | 12/2010 | Johnson et al. | 30/34.2 |
| 2011/0203113 | A1 * | 8/2011 | Wang | 30/41 |
| 2012/0030945 | A1 * | 2/2012 | Clarke et al. | 30/41 |

FOREIGN PATENT DOCUMENTS

| | | | |
|---|---|---|---|
| EP | 0 477 132 | A1 | 3/1992 |
| GB | 2 264 888 | A | 9/1993 |
| GB | 2 354 474 | A | 3/2001 |
| GB | 2 413 980 | A | 11/2005 |
| WO | WO 92/06827 | | 4/1992 |
| WO | WO 95/29043 | | 11/1995 |
| WO | WO 99/50034 | | 10/1999 |
| WO | WO 00/37227 | | 6/2000 |
| WO | WO 2004/069496 | A1 | 8/2004 |
| WO | WO 2010/068075 | A2 | 6/2010 |

* cited by examiner

GUARD FOR A SHAVING RAZOR

CROSS REFERENCE TO RELATED APPLICATIONS

This application claims the benefit of U.S. Provisional application No. 61/541,692, filed Sep. 30, 2011.

FIELD OF THE INVENTION

The present invention relates to wet shaving razors, and more particularly, to wet shaving razor cartridges having an elastomeric guard for facilitating stretching of skin

BACKGROUND OF THE INVENTION

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

Embodiments of the present invention may achieve one or more of the following advantages. Proper hair orientation, facilitating passage of shave prep to the blades, decreased frictional drag, and increased stretching of the skin can be achieved simultaneously without sacrificing the overall stretching of the skin. In addition, it is believed the various embodiments of the present invention will provide reduced nicks, improved closeness, better tactile feel during shaving, and improved overall comfort. Other advantages and features of the present invention will be apparent from the following detailed description and from the claims.

SUMMARY OF THE INVENTION

In one aspect, the invention features, in general a shaving cartridge with a housing, cap at a rear of the housing, one or more blades mounted to the housing in front of the cap, and a guard at a front of the housing. The guard has a top surface with a plurality of undulating rows extending parallel to the blade. The undulating rows have crests and valleys. The valleys comprise an elastomeric material and are stepped from a front of the guard to a rear of the guard.

DETAILED DESCRIPTION OF THE INVENTION

Figure 1A:
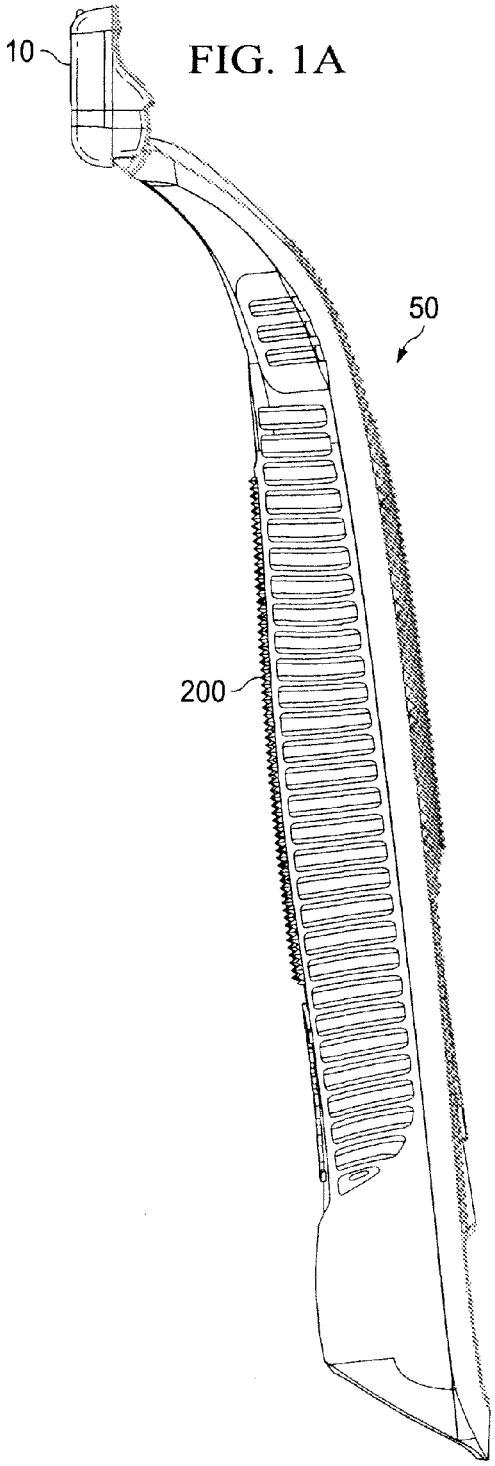
FIG. 1A is a side view of one possible embodiment of a shaving razor in a rest position
Figure 1B:
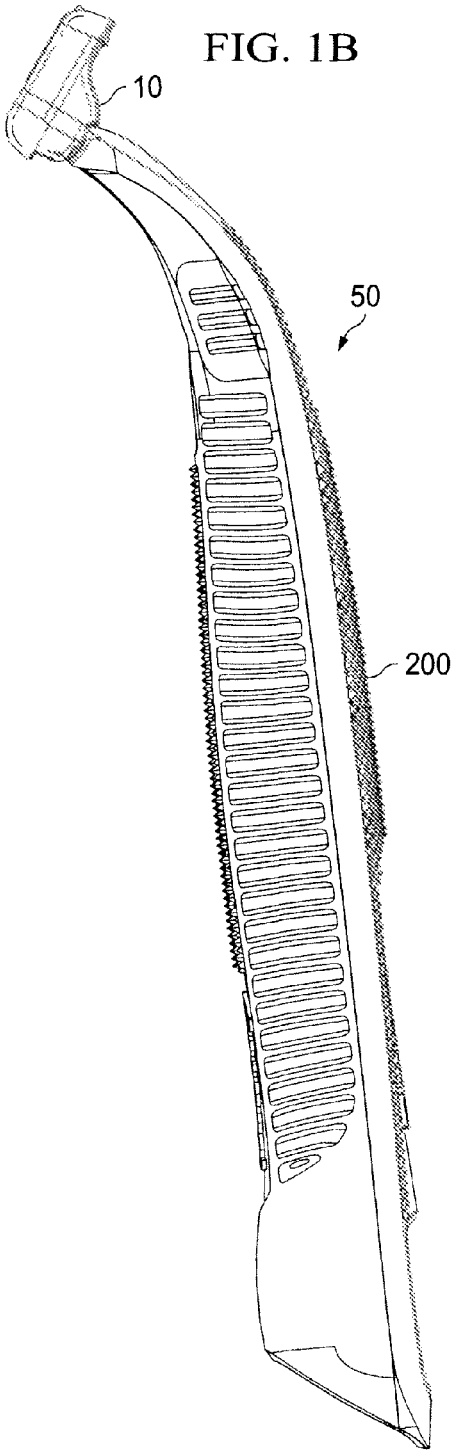
FIG. 1B is a side view of the shaving razor of FIG. 1B in a pivot position.

Referring to FIGS. 1A and 1B side views of one possible embodiment of a shaving razor 50 are shown. The shaving razor 50 may have a cartridge 10 mounted to a handle 200. As will be explained in greater detail below, the cartridge 10 may pivot relative to the handle 200 between a rest position (as shown in FIG. 1A) and a pivot position (as shown in FIG. 1B). The handle 200 may bias the cartridge 10 back towards the rest position. The shaving razor 50 may have a front pivot (i.e., pivot axis in front of the blades) or a center pivot (i.e., center pivot between a forward most blade and a rearward most blade), or a rear pivot (i.e., between the rearward most blade and a cap).

Figure 2:
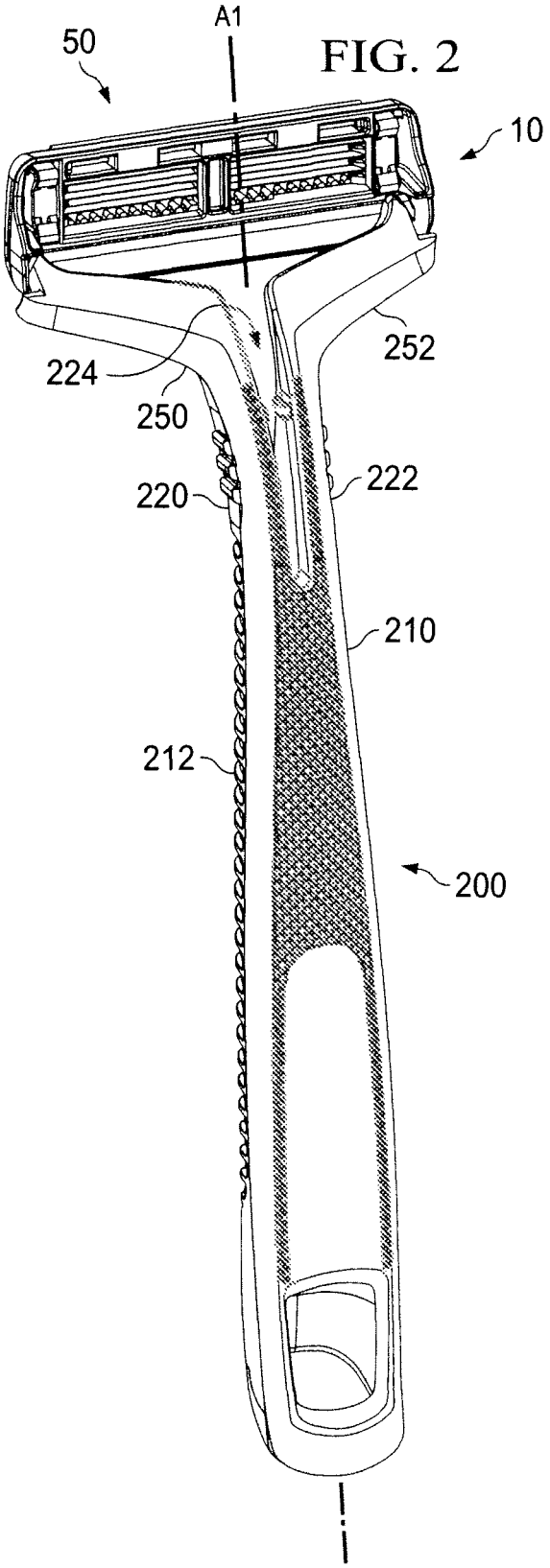
FIG. 2 is a perspective view of the shaving razor of FIG. 1A.

Referring to FIG. 2, a perspective view of the shaving razor 50 is shown in the rest position. In certain embodiments, the cartridge 10 may be detached from the handle 200 and replaced. The handle 200 may have an elongated body 210 with one or more gripping features 212, such as a textured surface, depressions, ribs, or an elastomeric covering. A pair of spaced apart resilient integral arms 220 and 222 may extend from the body 200 and toward the cartridge 10. The resilient integral arms 220 and 222 may define a slot 224 extending into the elongated body 210. In certain embodiments, the slot 224 may extend generally along a longitudinal axis A1 of the elongated body 210. A cartridge support member 250 and 252 may extend outwardly from each of the resilient integral arms 220 and 222. The cartridge 10 may be pivotably mounted to the cartridge support members 250 and 252.

The handle 200 may be molded from polymeric such as high impact polystyrene (HIPS), but other semi-rigid polymers such as polypropylene (PP), polycarbonate (PC), and acrylonitrile butadiene styrene (ABS) may also be used. The molding of the handle 200 as a one piece design (i.e., resilient integral arms 220 and 222, the body 210, and the cartridge support members 250 and 252) provides for a low cost shaving razor with an integral biasing and pivoting mechanism without the need for additional components such as springs, tongues, or cam followers, which may not operate smoothly over time. Furthermore, the cartridge 10 and cartridge support members 250 and 252 may define an open space there between for the unobstructed passage of water for improved rinsing while also providing pivoting and biasing functionality.

Figure 3:
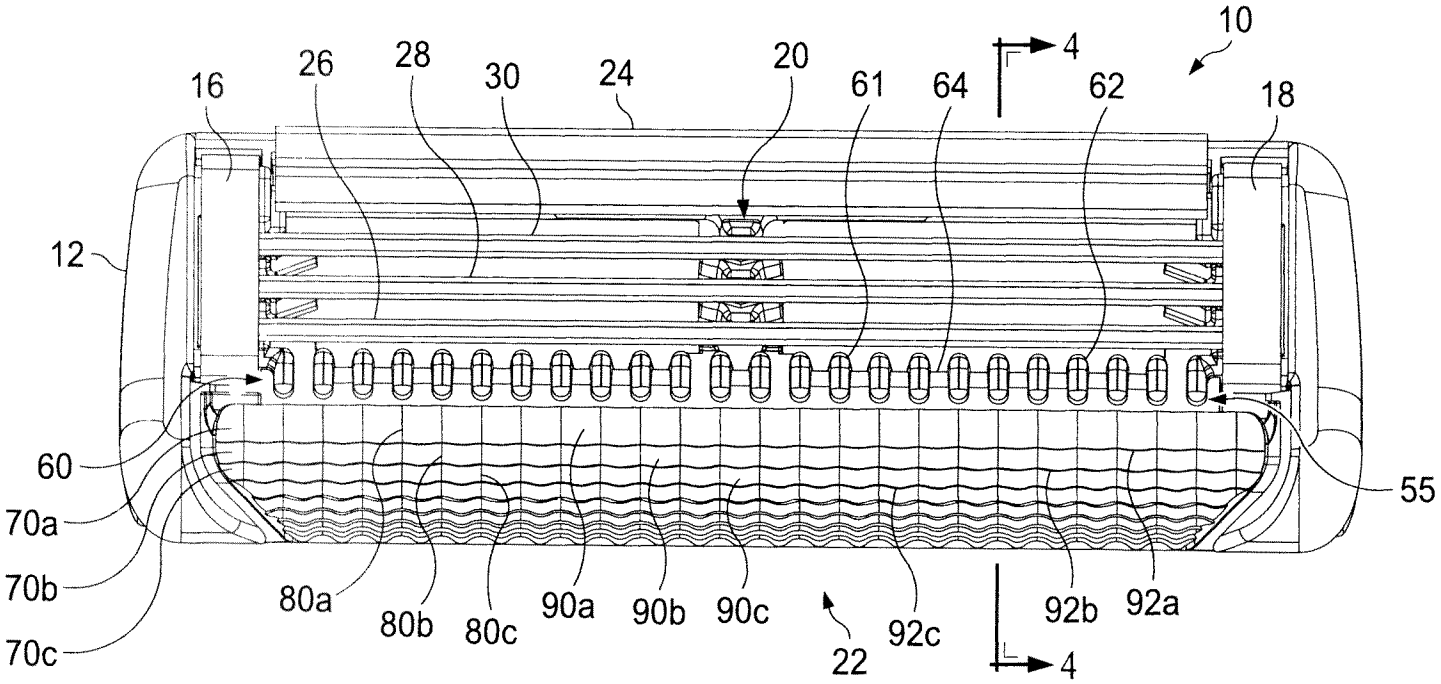
FIG. 3 is a top view of a cartridge that may be incorporated into the shaving razor of FIG. 1A.

Referring to FIG. 3, a top view of the cartridge 10 of FIG. 2 is shown. The cartridge 10 may have a housing 12 with a top surface 20 and an opposing bottom surface (not shown). The top surface 20 may include a guard 22, a cap 24 (e.g., lubricating member), and at least one blade. For example, the housing 12 may have a first blade 26, a last blade 30, and one or more intermediate blades 28 positioned between the guard 22 and the cap 24. Although three blades 26, 28, and 30 are shown, the housing 12 may have more or fewer blades depending on the desired performance and cost of the shaving razor 50. In certain embodiments, the blades 26, 28, and 30 may be mounted to the housing 12 and secured by one or more clips 16 and 18. Other assembly methods known to those skilled in the art may also be used to secure and/or mount the blades 26, 28, and 30 to the housing 12 including, but not limited to, wire wrapping, cold forming, hot staking, insert molding, ultrasonic welding, and adhesives.

The cap 24 may be a separate molded or extruded component that is mounted to the housing 12. The cap 24 may be molded or extruded from the same material as the housing 12 or may be molded or extruded from a more lubricious shaving aid composite that has one or more water-leachable shaving aid materials to provide increased comfort during shaving. The shaving aid composite may comprise a water-insoluble polymer and a skin-lubricating water-soluble polymer. Suitable water-insoluble polymers which may be used include, but are not limited to, polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, may have a high impact polystyrene (i.e., Polystyrene-butadiene), such as Mobil 4324 (Mobil Corporation).

Suitable skin lubricating water-soluble polymers may include polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Union Carbide Corporation) or ALKOX (available from Meisei Chemical Works, Kyota, Japan). These polyethylene oxides may have molecular weights of about 100,000 to 6 million, for example, about 300,000 to 5 million. The polyethylene oxide may comprises a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also contain up to about 10% by weight of a low molecular weight (i.e., MW<10, 000) polyethylene glycol such as PEG-100.

The shaving aid composite may also optionally include an inclusion complex of a skin-soothing agent with a cylcodextrin, low molecular weight water-soluble release enhancing agents such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, moisturizers, cooling agents, etc.

Figure 4:
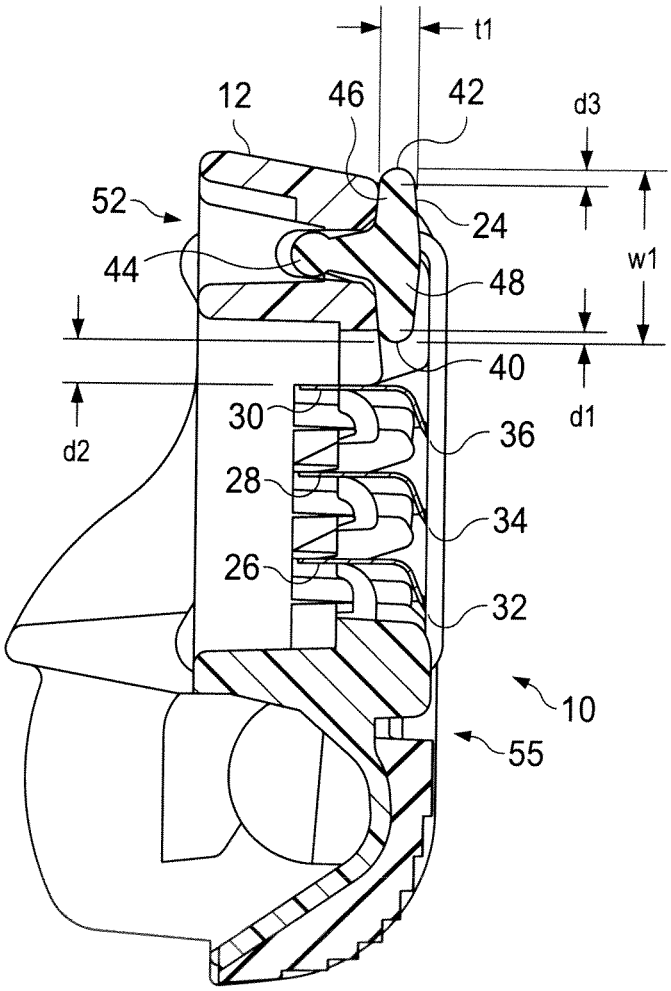
FIG. 4 is a cross sectional schematic view of the cartridge of FIG. 3, taken generally along the line 4-4 of FIG. 3.

The housing 12 may have a comb guard 60 between the guard 22 and the first blade 26. The comb guard 60 may have a plurality of spaced projections 62. The projections 62 may define a plurality of open channels 64 extending transverse to the blades 26, 28, and 30. Adjacent projections 62 may be spaced apart (i.e., width of open channels 64) by a distance of about 0.10 mm, 0.20 mm, or 0.30 mm to about 0.35 mm, 0.40 mm, or 0.49 mm to facilitate the generally unobstructed passage of hair and minimize pulling and grabbing of hair during shaving. The thickness and amount of hair to be shaved may require the width of the open channels 64 to be larger or smaller depending on the application. In certain embodiments, the open channels 64 may taper inward and rearward. For example, the open channels 64 may have a width toward the guard 22 that is greater than a width toward the first blade 26. The projections 62 may have a width that is generally equivalent to the width of the open channels 64, for example, about 0.10 mm, 0.20 mm or 0.30 mm to about 0.35 mm, 0.40 mm, or 0.49 mm However, the width of the projections 62 may also be larger or smaller depending on the desired total contact area with the skin surface. A larger contact area with the surface of the skin may increase skin support and result in less discomfort. In certain embodiments, the projections 62 may be spaced apart from the guard 22 to define an elongated gap 55 extending parallel to the blades 26, 28, and 30, as shown in FIGS. 3 and 4.

The comb guard 60 may be molded from a generally rigid material to allow the housing 12 to maintain a consistent geometry during shaving and enhance the ability of the spaced apart projections 62 to lift and orient hairs. In addition, the plurality of projections 62 may set the shaving plane (i.e., a tangent line from the cap 24 to the projections 62). The spaced apart projections 62 may be of sufficient stiffness such that they generally do not bend or flex under normal shaving conditions, which may adversely influence shave geometry. In certain embodiments, the comb guard 60 may be molded from the same material as the housing 12, for example, Noryl™ (a blend of polyphenylene oxide (PPO) and polystyrene developed by General Electric Plastics, now SABIC Innovative Plastics). The comb guard 60 may be molded from other semi-rigid polymers e.g., materials having a Shore A hardness of about 50, 60 or 70 to about 90, 110, or 120. For example, high impact polystyrene (HIPS), polypropylene (PP), acrylonitrile butadiene styrene (ABS), polycarbonate (PC), and combinations thereof may also be used.

The guard 22 may have a plurality of undulating rows 70 (e.g., 70*a*, 70*b*, 70*c*) extending across the housing and generally parallel to the blades 26, 28, and 30. Each of the undulating rows 70*a* may have a plurality of crests 80 and valleys 90 (e.g., about 10 to about 30 crests 80 and about 10 to about 30 valleys 90). The crests 80 (e.g., crests 80*a*) of one of the undulating rows 70 (e.g., 70*a*) may be generally aligned with one or more of the crests 80 (e.g., 80*b* or 80*c*) of the other undulating rows 70 (e.g., 70*b* and 70*c*). In certain embodiments, the valleys 90 and crests 80 of at least one of the undulating rows 70 may have a pitch (e.g., the distance from the center of one crest 80 to the center of the immediate adjacent crest 80) of about 0.75 mm, 0.85 mm, or 0.95 mm to about 1.25 mm, 1.50 mm, or 2.0 mm The guard may comprise a single unitary member comprising a single material. In certain embodiments, the guard 22 may be insert injection molded or co-injection molded to the housing 12. However, other known assembly methods may also be used such as adhesives, ultrasonic welding, or mechanical fasteners. The guard 22 (and thus the undulating rows 70) may be molded from a softer material (i.e., lower durometer hardness) than the housing 12 and/or the plurality of projections 60. For example, the guard 22 may have a Shore A hardness of about 20, 30, or 40 to about 50, 60, or 70. The guard 22 may be made from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, guard 22 may comprise Kraiburg HTC 1028/96, HTC 8802/37, HTC 8802/34, or HTC 8802/11 (KRAIBURG TPE GmbH & Co. KG of Waldkraiburg, Germany). A softer material may enhance skin stretching, as well as provide a more pleasant tactile feel against the skin of the user during shaving. A softer material may also aid in masking the less pleasant feel of the harder material of the housing 12 and/or the plurality of projections 62 against the skin of the user during shaving.

The valleys 90 may have a depth of about 0.1 mm to about 0.6 mm The depth of the valleys 90 may be consistent within one or more of the undulating rows 70 (i.e., the valleys within an undulating row all have the same depth). The height of the crests may be consistent within one of more of the undulating rows 70. The combination of the depth of the valleys 90 and elastomeric material that comprises the guard 22 (and thus the valleys 90) may allow for skin stretch to occur not only at the crests 80, but at the valleys 90 of the guard 22. The valleys 90 may also allow shave prep (e.g., that is applied to the skin prior to shaving) to pass to one or more of the blades 26, wherein typical fin guards may remove too much shave prep, thus negatively affecting shaving efficiency. Each of the undulating rows 70 may have a forward edge 92 (e.g., 92*a*, 92*b*, and 92*c*) to facilitate the stretching of skin by increasing drag of the guard 22 against the skin during a shaving stroke. Accordingly, the crests 80 and the valleys 90 may be stepped in a direction transverse to the blades 26, 28, and 30, with the undulating rows 70 closer to the blades 26, 28, and 30 being taller than the undulating rows at the front of the cartridge 10 (i.e., further away from the blades 26, 28, and 30). Each of the undulating rows may have a width of about 0.1 mm, 0.2 mm, or 0.3 mm to about 0.8 mm, 0.9 mm, or 1.3 mm (extending in a direction transverse to the blades 26, 28, and 30) from one forward edge 92 (e.g., the forward edge 92*a*) to the next forward edge (e.g., the forward edge 92*b*). The width of the undulating rows 70 (e.g., the undulating rows 70*a*) may be greater closer at the rear of the guard 22 (e.g., toward the first blade 26 than the width of the undulating rows 70 (e.g., the undulating row 70*c*) toward the front of the guard 22 (i.e., further from the blades 26, 28, and 30). The height of the forward edge 92 may be greater at the front of the guard, further from the blades 26, 28, and 30 than at the rear of the guard 22, closer to the blades 26, 28, and 30. The height of the forward edge may be about 0.1 mm, 0.2 mm, or 0.3 mm to about 0.6 mm, 0.7 mm, or 0.8 mm In certain embodiments, the height of the undulating row 70*a* (i.e., the crest 80*a*) closest to the first blade 26 may about 0.1 mm or 0.2 mm to about 0.3 mm or 0.5 mm above a top surface 61 of the plurality of protrusions 60. If the first undulating row 70*a* is too low (e.g., below the top surface of the plurality of protrusions 60) the guard 22 may not have sufficient skin engagement. If the first undulating row 70*a* is too high, the guard 22 may lift skin away from the blade, thus decreasing the closeness of the shave. In addition, if the guard 22 is too high, cap 24 and the guard 22 would set the shaving plane, not cap 24 and the comb guard 60 (i.e., spaced apart projections 62). The position of the top of the guard 22 (i.e., crests 80) slightly above the comb guard 60 provides for proper skin stretching without sacrificing closeness. The valleys 90 of the guard 22 may be generally aligned with the open channels 64 between the plurality of projections 62 to facilitate the passage of shave prep to the blades 26, 28, 30.

Referring to FIG. 4 a cross sectional schematic view of the cartridge 10 is shown, taken generally along the line 4-4 of FIG. 3. The first blade 26 may be positioned in front of the comb guard 60. One or more of the intermediate blades 28 may be positioned between the first blade 26 and the last blade 30. Each of the blades 26, 28, and 30 may have a respective elongated blade edge 32, 34, and 36. In certain embodiments, the cap 24 may be a separate component that is secured to the housing 12. The cap 24 may be positioned immediately behind the last blade 30. The cap 24 may have a body 44 with a pair of forward and rearward wings 46 and 48 that extend outwardly from the body to a respective front face 40 and a rear face 42. The housing 12 may define an elongated opening 52 that is dimensioned to receive the body 44 of the cap 24. The cap 24 may be press fit, snap fit, or glued to the housing 12; however other known assembly methods may also be used.

In certain embodiments, the cap 24 (e.g., lubricating member) may comprise a leachable shaving aid secured to the housing 12. The wings 46 and 48 may have a thickness "t1" of about 0.1 mm, 0.2 mm, or 0.3 mm to about 0.8 mm, 0.9 mm, or 1.0 mm The front face 40 may be positioned behind the last blade 30 and extend generally parallel to the blade edge 36. The front face 40 of the lubricating may be unsupported by the housing 12. The front face 40 of the cap 24 may extend over the housing 12 by a distance "d1". For example, the front face 40 of the cap 24 may extend over the housing 12 by about 0.1 mm, 0.2 mm, or 0.3 mm to about 0.8 mm, 0.9 mm, or 1.0 mm for allowing the skin to contact the smoother and more lubricious cap 24 instead of the housing 12. The cap 24 extending over the housing 12 maximizes the width of the cap 24 without compromising the rinsing space between the last blade 36 and the housing 12. In addition, extending the front face 40 of the cap 24 beyond the housing 12 allows water improved access to the cap 24 (e.g., under the front face 40 of the cap 24), thus allowing the water leachable shaving aid of the cap 24 to absorb more water and release more lubricants. Furthermore, the front face 40 of the cap 24 is not constrained by the housing 12, which may allow for increased swelling of the cap 24 (e.g., toward the last blade). The front face 40 may have an accurate profile to facilitate the flow of skin over the cap 24 during a shaving stroke. The front face 40 may be spaced apart from the last blade 30 by a horizontal distance d2 about 0.1 mm, 0.2 mm, or 0.3 mm to about 0.8 mm, 0.9 mm, or 1.0 mm In certain embodiments, the rear face 42 may overhang the housing 12 by a distance "d3" of about 0.1 mm, 0.2 mm, or 0.3 mm to about 0.8 mm, 0.9 mm, or 1.0 mm The rear face 42 may provide similar benefits as previously mentioned for the front face 40. In addition, the consumer may rotate the handle and drag the rear face 42 against the skin to add lubrication (or other ingredients) to the skin without dragging the blades 26, 28, and 30 against the skin. Accordingly, the geometry of the cap 24 may not be limited by the geometry of the housing 12. The overhang of the front face 40 and the rear face 42 may provide for a larger width of the cap 24. For example, the cap 24 may have a width of about 2.0 mm, 2.5 mm, or 3 mm to about 4.0 mm, 4.5 mm, or 5.0 mm In certain embodiments, the width of the cap 24 from the front face 40 to the rear face 42 may be greater than the span from the first blade edge to the last blade edge to provide increased comfort and lubrication. It is believed, without being held to theory, increasing the number of blades and thus the overall span from the first blade to the last blade may improve closeness, but may also increase irritation. Accordingly, the width of the cap 24 having a water leachable shaving aid composite should be greater than or equal to a span from the first blade edge 32 to the last blade edge 36 for increased comfort by accounting for any increase in irritation caused by the blades. In addition, the overhang of the front face 40 and/or the rear face 42 may allow for the cartridge 10 to be modular. For example, the same housing 12 may be used for a smaller cap 24 with fewer blades, or a larger with more blades.

Figure 5:
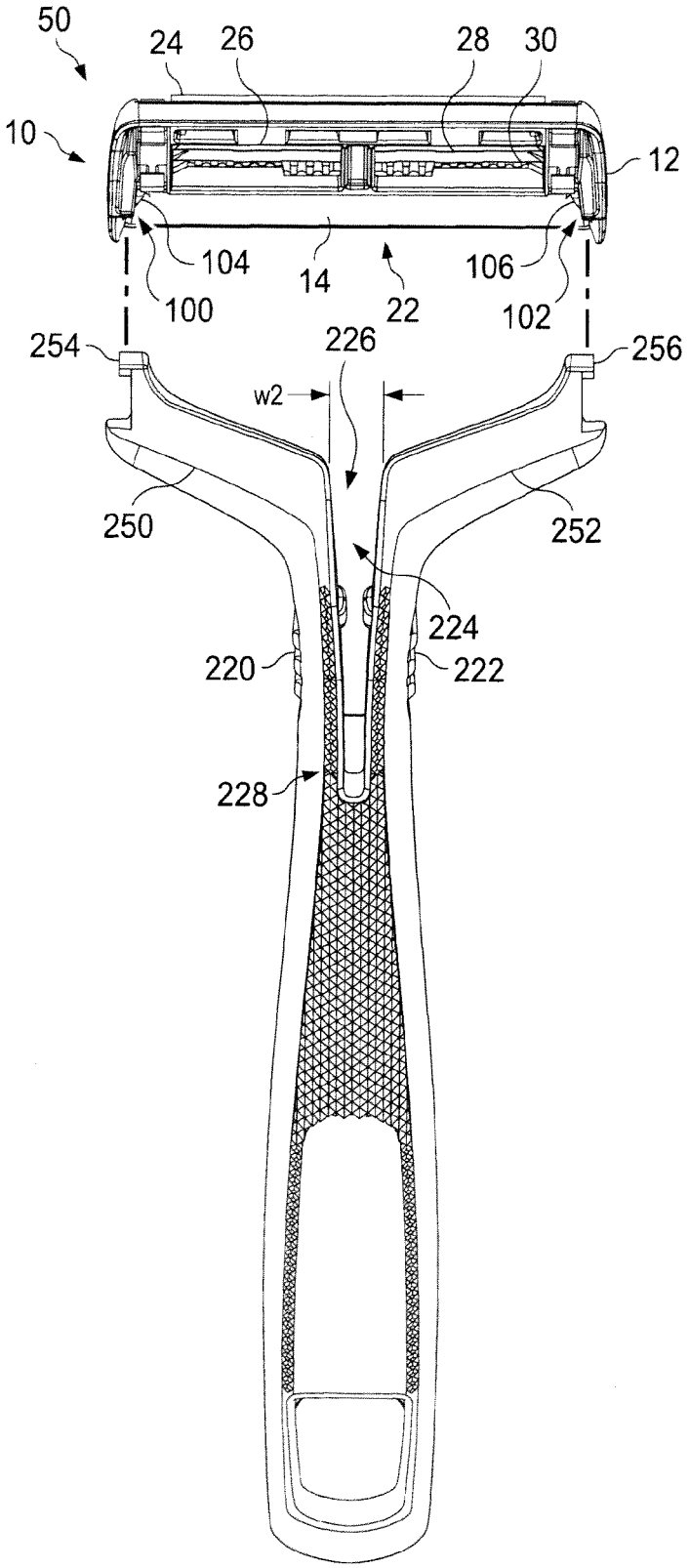
FIG. 5 is an assembly view of the shaving razor of FIG. 1A.
Figure 6:
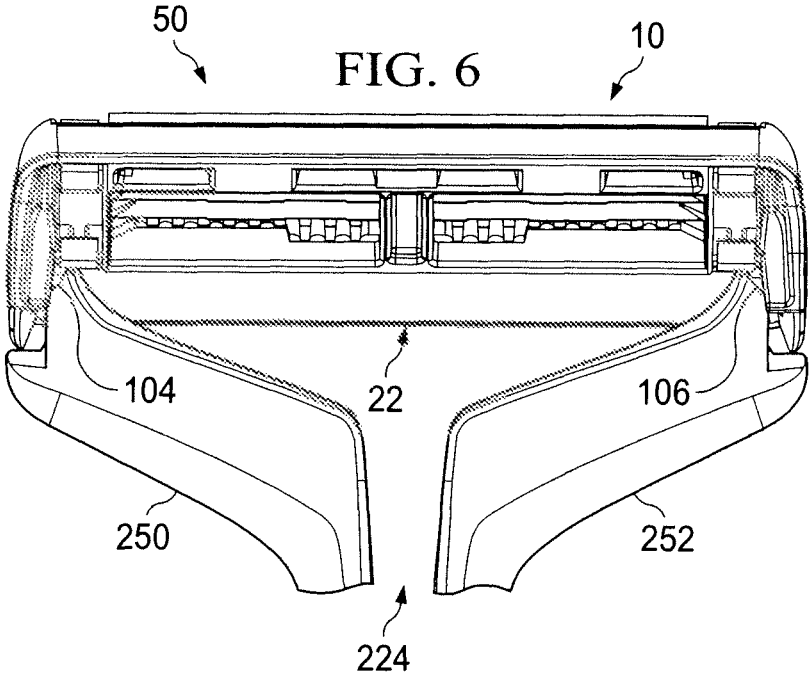
FIG. 6 is an enlarged bottom view of the shaving razor of FIG. 1A.

Referring to FIGS. 5 and 6, an assembly view and an enlarged view of the shaving razor 50 of FIG. 1 are shown. The cartridge 10 of the shaving razor 50 may pivot between a rest position and a pivot position, as shown in FIGS. 1A and 1B, respectively. The cartridge 10 may have a pivot angle relative to the handle 200 of about 10 degrees to about 50 degrees. As the cartridge 10 pivots relative to the handle 200, the cartridge 10 may be biased back toward the rest position by the cartridge support members 250 and 252 of the handle 200. The housing 12 of the cartridge 10 may have a bottom surface 14 that defines one or more mating features 100 and 102 (e.g., a pair of sockets). The bottom surface 14 that defines the one or more mating features 100 and 102 100 and 102 may have a pair of respective cam faces 104 and 106 that taper inward (e.g., toward each other) and rearward (e.g., toward the cap 24). In certain embodiments, the cam faces 104 and 106 may be positioned forward of the first blade 26 (e.g., under the guard 22) to provide a front pivot axis for the cartridge 10. In other embodiments, the cam faces 104 and 106 may be positioned between the first blade 26 and the last blade 30 (i.e., providing a center pivot axis for the cartridge 10). The one or more mating features 100 and 102 may be configured to receive a distal end 254 and 256 of the cartridge support members 250 and 252. The distal ends 254 and 256 may extend outwardly from the respective cartridge support members 250 and 252. The distal ends 254 and 256 may be pins that are positioned within the respective one or more mating features 100 and 102 to facilitate the pivoting of the cartridge. In certain embodiments, the distal ends 254 and 256 may define an opening to receive a corresponding pin on the housing 12 to facilitate the pivoting of the cartridge. Each cam face 104 and 106 may slidingly engage one of the respective cartridge support members 250 and 252 as the cartridge 10 pivots relative to the handle 200. The cam faces 104 and 106 may receive forces from the handle 200 to bias the cartridge 10 in the rest position. As the cartridge 10 pivots relative to the handle 200, the cam faces 104 and 106 may force the cartridge support member 250 and 252 and/or the resilient integral arms 220 and 222 inward toward each other (e.g., the cartridge support member 250 and 252 and/or the resilient integral arms 220 and 222 may flex from their original position). The slot 224 may taper inwardly from an open end 226 to a closed portion 228 to provide the proper biasing forces as the cartridge 10 pivots. For example, the smaller open end 226 may provide for a positive stop and the larger closed portion 228 may provide added flexibility. When the force acting against the cartridge 10 is removed (or decreased), the cartridge support member 250 and 252 and/or the resilient integral arms 220 and 222 may return back toward the rest position. The arms 220 and 222 may flex inward about 0.2 mm, 0.5 mm, or 0.75 mm to about 0.9 mm, 1.5 mm, or 2.0 mm at the slot 224 between the rest position and the pivot position. In certain embodiments, the slot width "w2" at the open end may be about 0.5 mm, 0.75 mm, or 1 mm to about 2 mm, 3 mm, or 4 mm in either the pivot position or the rest position. The slot width "w2" may be greater in the rest position than the pivot position.

In certain embodiments the handle 200 may comprise a polymeric material having a hardness that is different than a polymeric material of the housing 12. For example, the housing 12 may be molded from HIPS having a durometer hardness of about 53 to about 100 (e.g., Rockwell R scale) and the handle 200 may be molded from ABS having a hardness of about 100 to about 120 (e.g., Rockwell R scale). It is believed, without being held to theory, the harder material of the handle 200 will provide improved wear properties against the cam faces of the housing. Accordingly, over long term use and repeated pivoting of the cartridge 10, the biasing forces of the handle 200 will remain constant (or even increase) and not drop off because of wear of the handle 200.

In certain embodiments, the slot 224 may define an open space. In other embodiments, the slot 224 may be filled with a material that is softer than a material comprising the handle 200. For example, the slot 224 may be filled with a material having Shore A hardness of about 20, 30, or 40 to about 50, 60, or 70. Materials may include thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, the slot 224 may be filled with Kraiburg HTC 1028/96, HTC 8802/37, HTC 8802/34, or HTC 8802/11 (KRAIBURG TPE GmbH & Co. KG of Waldkraiburg, Germany). A softer material within the slot 224 may provide for improved biasing of the cartridge 10 and may decrease premature failure of the resilient integral arms 220 and 222.

Figure 7A:
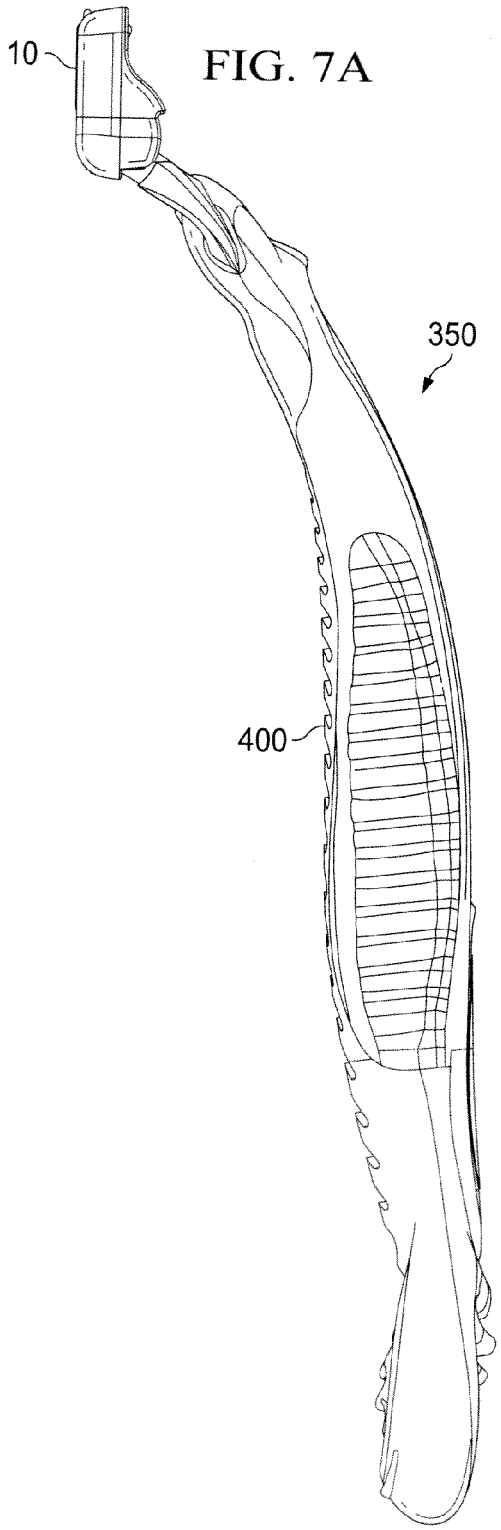
FIG. 7A is a side view of another possible embodiment of a shaving razor with the cartridge of FIG. 3 in a rest position
Figure 7B:
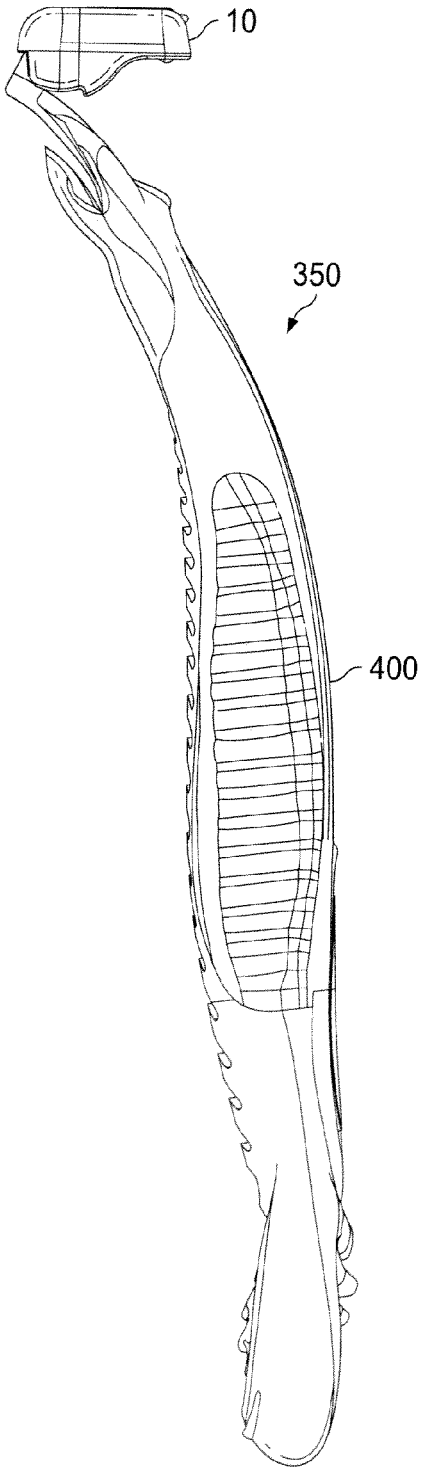
FIG. 7B is a side view the shaving razor of FIG. 7A with the cartridge of FIG. 3 in a pivot position.

Referring to FIGS. 7A and 7B side views of another possible embodiment of a shaving razor 350 are shown. The shaving razor of 350 may be similar to the shaving razor 50 of FIGS. 1A and 1B previously described above and may also incorporate the same cartridge 10. The shaving razor 350 may include the cartridge 10 mounted to a handle 400. As will be explained in greater detail below, the cartridge 10 may pivot relative to the handle 400 between a rest position (as shown in FIG. 7A) and a pivot position (as shown in FIG. 7B). The handle 400 may bias the cartridge 10 back towards the rest position. The shaving razor 350 may have a front pivot (i.e., pivot axis in front of the blades) or a center pivot (i.e., center pivot between a forward most blade and a rearward most blade), or a rear pivot (i.e., between the rearward most blade and a cap).

Figure 8:
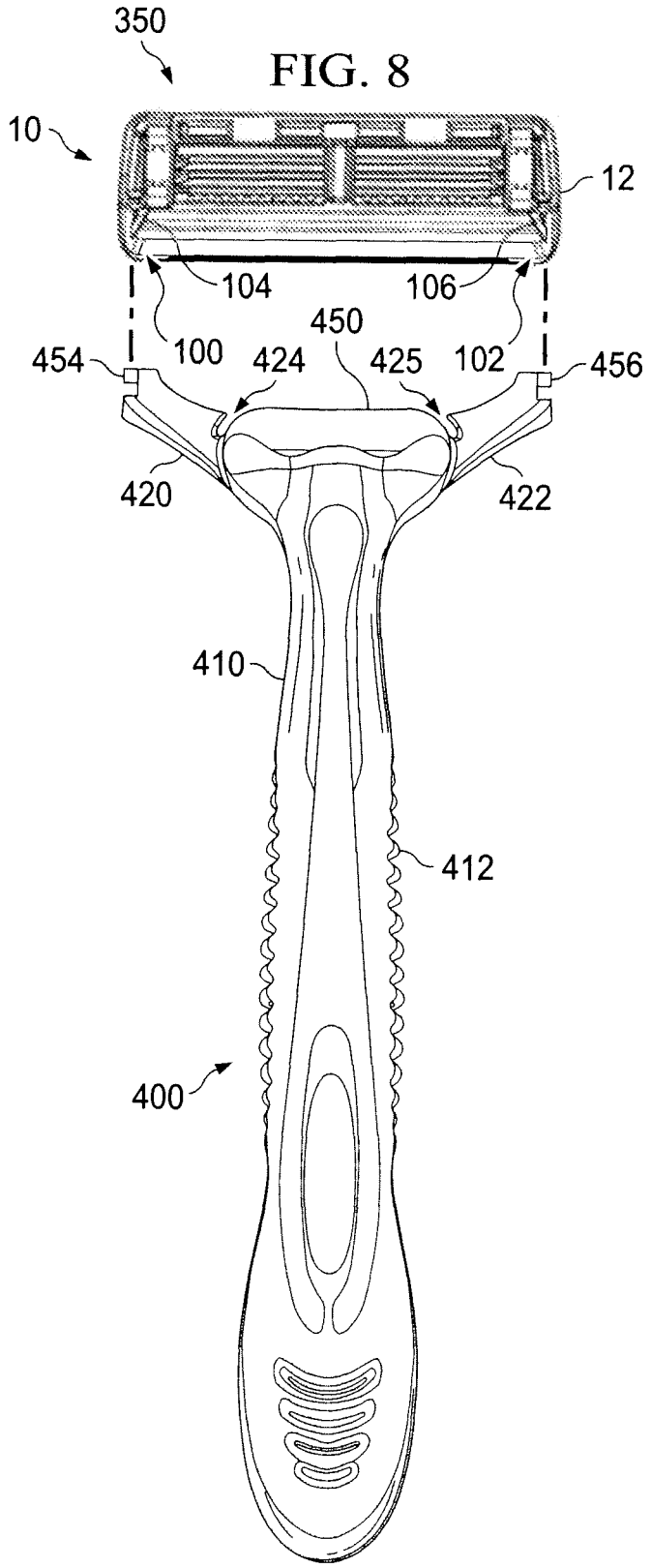
FIG. 8 is an assembly view of the shaving razor of FIG. 7A.
Figure 9:
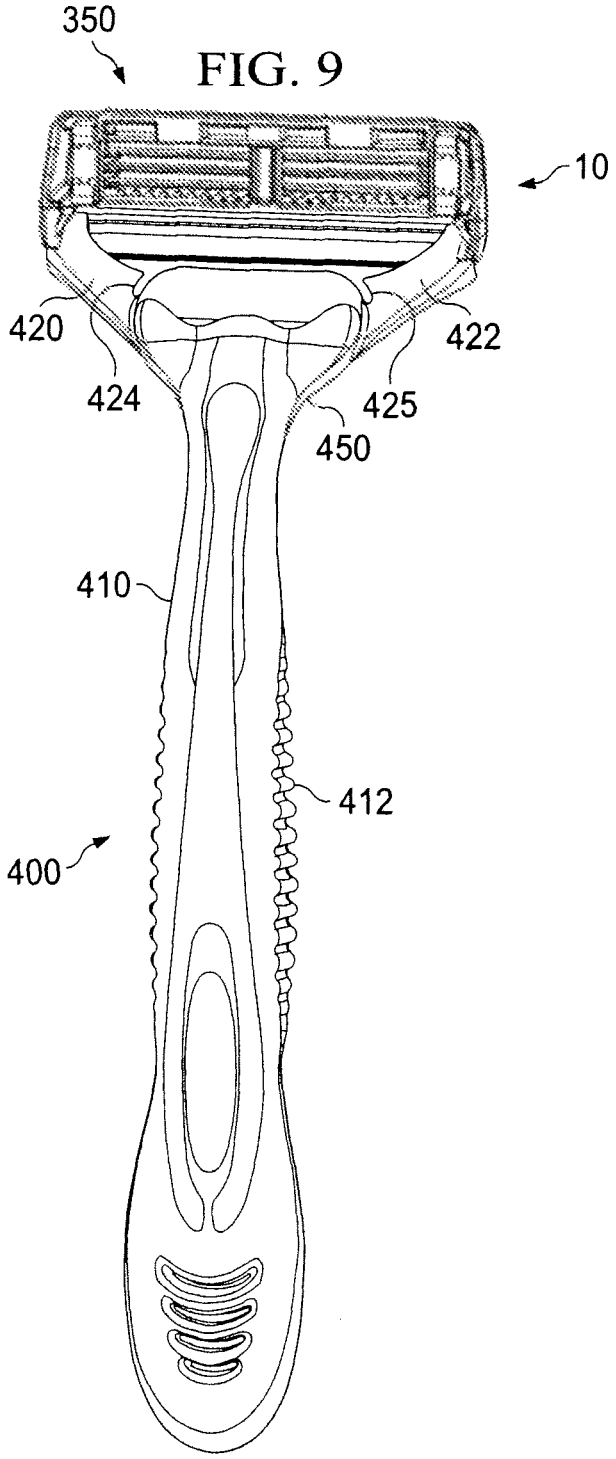
FIG. 9 is a perspective view of the shaving razor of FIG. 7A.

Referring to FIGS. 8 and 9, an assembly view and a perspective view of the shaving razor 350 are shown. In certain embodiments, the cartridge 10 may be detached and removed from the handle 400 by the consumer so the cartridge 10 can be replaced as needed. The handle 400 may have an elongated body 410 with one or more gripping features 412, such as a textured surface, depressions, ribs, or an elastomeric covering. The handle 400 may have a head 450 at one end of the elongated body 410. A pair of spaced apart resilient integral arms 420 and 422 may extend outward from the head 450. The cartridge 10 may be pivotably mounted to the respective resilient integral arms 420 and 422. The integral resilient arms 420 and 422 may have a distal end 454 and 456 that is configured to mate with the respective mating feature 100 and 102. The distal ends 454 and 456 may extend outwardly from the respective integral resilient arms 420 and 422. In certain embodiments the distal ends 454 and 456 may be pins that are positioned within the respective one or more mating features 100 and 102 to facilitate the pivoting of the cartridge. In other embodiments, the distal ends 454 and 456 may define an opening to receive a corresponding pin on the housing 12 to facilitate the pivoting of the cartridge. Each cam face 104 and 106 may slidingly engage one of the respective integral resilient arms 420 and 422 as the cartridge 10 pivots relative to the handle 400. The cam faces 104 and 106 may receive forces from the handle 400 to bias the cartridge 10 in the rest position. As the cartridge 10 pivots relative to the handle 400, the cam faces 104 and 106 may force the resilient integral arms 420 and 422 inward toward each other (e.g., the resilient integral arms 420 and 422 may flex from their original position).

The resilient integral arms 420 and 422 may each define a slot 424 and 425 extending generally transverse into the respective resilient integral arms 420 and 422. In certain embodiments, the slots 424 and 425 may be generally arcuate and extend inwardly around a portion of the head 450. One or more of the slots 424 and 425 may extend about 15%, 20%, or 25% to about 40%, 50%, or 60% into one of the respective resilient integral arms 420 and 422 and/or head 450. In certain embodiments, one or more of the slots 424 and 425 may extend about up to 95% into one of the respective resilient integral arms 420 and 422 and/or head 450. For example, the slots 424 and 425 may extend more into the resilient integral arms 420 and 422 if they are filled with an elastomeric material.

Figure 10:
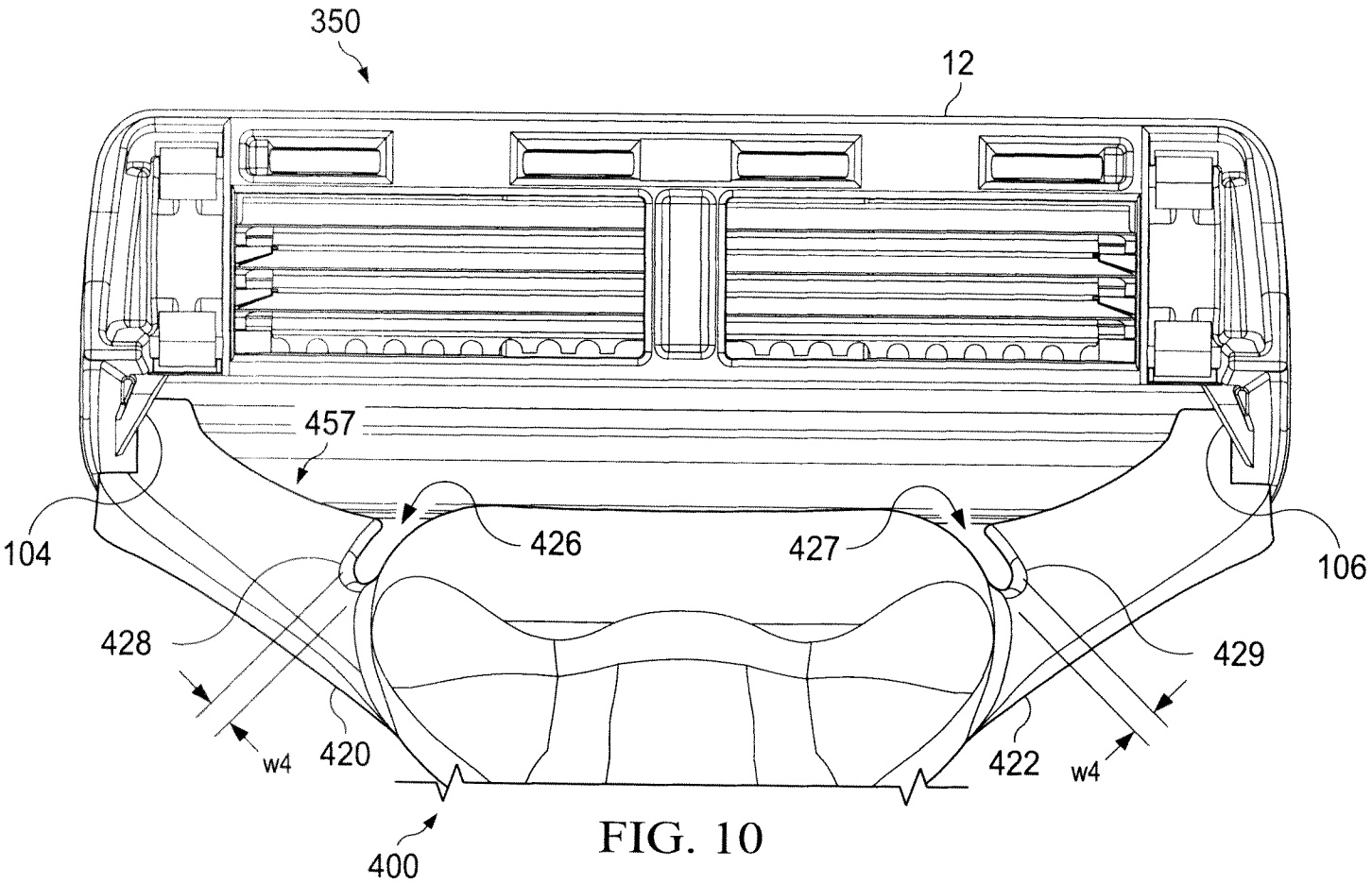
FIG. 10 is an enlarged bottom view of the shaving razor of FIG. 9.

Referring to FIG. 10, an enlarged view of the shaving razor 350 is illustrated. Each of the slots 424 and 425 may each have a respective open end 426 and 427 and a respective closed portion 428 and 429. In certain embodiments, the slot may have a slot width "w4" at the open end of about 0.5 mm, 1 mm, or 1.5 mm to about 3 mm, 4 mm, or 5 mm in either the pivot position or the rest position. The slots width of the slots 424 and 425 may be greater in the rest position than the pivot position. When the force acting against the cartridge 10 is removed (or decreased), the resilient integral arms 420 and 422 may return back toward the rest position. The resilient integral arms 420 and 422 may flex about 0.1 mm, 0.15 mm, or 0.2 mm to about 0.3 mm, 0.4 mm, or 0.5 mm at the slot 424 and 425 between the rest position and the pivot position. In certain embodiments, the slots 424 and 425 may taper inwardly from the open end 426 and 427 a closed portion 428 and 429 to provide the proper biasing forces as the cartridge 10 pivots. For example, the smaller open end 426 and 427 may provide for a positive stop and the larger closed portion 428 and 429 may provide added flexibility.

In certain embodiments the handle 400 may comprise a polymeric material having a hardness that is different than a polymeric material of the housing 12. For example, the housing 12 may be molded from HIPS having a durometer hardness of about 53 to about 100 (e.g., Rockwell R scale) and the handle 400 may be molded from ABS having a hardness of about 100 to about 120 (e.g., Rockwell R scale). It is believed, without being held to theory, the harder material of the handle 400 will provide improved wear properties against the cam faces 104 and 106 of the housing 12. Accordingly, over long term use and repeated pivoting of the cartridge 10, the biasing forces of the handle 400 will remain constant (or even increase) and not drop off because of wear of the handle 400.

In certain embodiments, the slots 424 and 425 may define an open space. In other embodiments, the slots 424 and 425 may be filled with a material that is softer than a material comprising the handle 400. For example, the slots 424 and 425 may be filled with a material having Shore A hardness of about 20, 30, or 40 to about 50, 60, or 70. Materials may include thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, the slots 424 and 425 may be filled with Kraiburg HTC 1028/96, HTC 8802/37, HTC 8802/34, or HTC 8802/11 (KRAIBURG TPE GmbH & Co. KG of Waldkraiburg, Germany). A softer material within the slots 424 and 425 may provide for improved biasing of the cartridge 10 and may decrease premature failure of the resilient integral arms 420 and 422.

In certain embodiments, the handle 400 may be molded from the same material as the housing 12, for example, Noryl™ (a blend of polyphenylene oxide (PPO) and polystyrene developed by General Electric Plastics, now SABIC Innovative Plastics). The handle 400 may be molded from other semi-rigid polymers having a Shore A hardness of about 50, 60 or 70 to about 90, 110, or 120. For example, high impact polystyrene (HIPS), polypropylene (PP), acrylonitrile butadiene styrene (ABS), polycarbonate (PC), and combinations thereof may also be used. The molding (e.g., co-injection molding) of the handle 400 as a one piece design (i.e., resilient integral arms 420 and 422, the head 450, and body 410) provides for a low cost shaving razor with an integral biasing and pivoting mechanism without the need for additional components such as springs, tongues, or cam followers. Furthermore, the cartridge 10 and resilient integral arms 420 and 422 may define an open space there between for the unobstructed passage of water for improved rinsing while also providing pivoting and biasing functionality.

It is understood that that the elongated bodies 210 and 410 for the handles 200 and 400, as previously described, may be replaced with interconnect members that have one or more slots (similar to 224, and 424 and 425) to bias the cartridge 10. The interconnect member may then be mounted to a handle. Such interconnect members are described in U.S. Pat. Nos. 7,168,173 and 5,784,790, which are hereby incorporated by reference in their entirety.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" In an effort to avoid any ambiguity, for the purposes of this disclosure, the term "about" shall be construed as meaning within general manufacturing tolerances.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A shaving cartridge comprising:

a housing;

a cap at a rear end of the housing;

at least one blade mounted to the housing in front of the cap;

a guard at a front of the housing, the guard having a top surface with a plurality of rows, each row comprising an undulation extending parallel to the blade and having a plurality of crests and valleys, the plurality of crests and valleys comprise an elastomeric material and are stepped in a direction transverse to the blades, with the undulation of the rows closer to the blades being taller than the undulation of the rows further away from the blades, and each crest is aligned in a front-rear direction with a crest in an adjacent row; and a comb guard between the guard and the at least one blade, the comb guard having a plurality of spaced apart projections generally aligned with the crests in the front-rear direction.

2. The shaving cartridge of claim 1 wherein the crests of one of the undulating rows is 0 mm to 0.5 mm above the projections of the comb guard.

3. The shaving cartridge of claim 1 wherein the valleys are arcuate.

4. The shaving cartridge of claim 1 wherein the crests are arcuate.

5. The shaving cartridge of claim 1 wherein the valleys have a depth of about 0.1 mm to about 0.6 mm.

6. The shaving cartridge of claim 1 wherein the top surface of the guard comprises a single unitary member comprising a single material.

7. The shaving cartridge of claim 1 wherein the material has a Shore A hardness of about 30 to about 90.

* * * * *